US005634780A

United States Patent [19]

Chen

[11] Patent Number: 5,634,780

[45] Date of Patent: Jun. 3, 1997

[54] HAND PUMP OF A DRINKING DEVICE FOR PUMPING WATER TO A DIVER

[76] Inventor: Jiunn L. Chen, Floor 7, No. 83, Li Kung Road, Taiping Hsiang, Taichung Hsien, Taiwan

[21] Appl. No.: 694,679

[22] Filed: Aug. 12, 1996

[51] Int. Cl.[6] ..... B63C 11/02; F04B 53/12

[52] U.S. Cl. ..... 417/553; 417/556; 222/383.1; 222/341; 405/186; 129/202.15

[58] Field of Search ..... 417/553, 556; 222/383.1, 341; 405/186; 128/202.15, 201.11

[56] References Cited

U.S. PATENT DOCUMENTS

| | | | |
|---|---|---|---|
| 3,752,604 | 8/1973 | Dorn | 417/553 |
| 4,398,533 | 8/1983 | Barker | 128/202.15 |
| 4,815,893 | 3/1989 | Feder | 405/186 |
| 5,389,024 | 2/1995 | Chen | 405/186 |
| 5,524,612 | 6/1996 | Chen | 128/202.15 |
| 5,533,879 | 7/1996 | Chen | 417/553 |

FOREIGN PATENT DOCUMENTS

| | | | |
|---|---|---|---|
| 96466 | 12/1960 | Netherlands | 417/553 |
| 308083 | 6/1955 | Switzerland | 417/553 |

*Primary Examiner*—Timothy Thorpe
*Assistant Examiner*—William Wicker
*Attorney, Agent, or Firm*—Charles E. Baxley

[57] ABSTRACT

A drinking device for a diver includes a water container and a hand pump for pumping water to the diver's mouth. The hand pump includes a piston rod slidably engaged in a housing and two discs secured to the piston rod for separating the housing into an upper and a lower chambers. A passage is formed in the lower portion of the piston rod and has an aperture for communicating with a space formed between the discs. A sealing ring is slidably disposed in the space and may move upward to enclose the aperture for pumping the water in the lower chamber out of the housing. The sealing ring may also move downward to open the aperture for allowing the water in the upper chamber to flow into the lower chamber.

3 Claims, 3 Drawing Sheets

HAND PUMP OF A DRINKING DEVICE FOR PUMPING WATER TO A DIVER

BACKGROUND OF THE INVENTION

1. Field of the Invention

The present invention relates to a hand pump, and more particularly to a hand pump for pumping water from a water container to a diver's mouth.

2. Description of the Prior Art

Typical diver facilities comprise a water container for supplying water to the diver's mouth. water containers are normally made of soft and flexible material that may be squeezed in order to supply water into the diver's mouth. However, the water may not be effectively supplied into the diver's mouth.

The present invention has arisen to mitigate and/or obviate the afore-described disadvantages of the conventional diver drinking devices.

SUMMARY OF THE INVENTION

The primary objective of the present invention is to provide a hand pump for effectively pumping water into the diver's mouth.

In accordance with one aspect of the invention, there is provided a drinking device for a diver, the drinking device comprises a water container, a hand pump including a housing having an inlet valve coupled to the water container for receiving water from the water container the housing including a lower portion having an outlet formed therein, the housing including an interior, a piston rod including a lower portion slidably engaged in the housing and including an upper portion having a handle secured thereon for operating the piston rod, the piston rod including a pair of discs secured to the lower portion and slidably engaged in the interior of the housing and arranged to form a space between the discs, the discs each including a notch formed therein for allowing water to flow through the discs, the discs separating the interior of the housing into an upper chamber and a lower chamber, a passage formed in the lower portion of the piston rod and including an opening for communicating with the lower chamber of the housing and including at least one aperture for communicating with the space, a sealing ring slidably disposed in the space and including a size smaller than that of the space fop allowing the sealing ring to move upward to close the aperture and for allowing the sealing ring to move downward to open the aperture, and means for biasing the discs toward the upper chamber of the housing. The sealing ring is moved downward to open the aperture for allowing water in the upper chamber to flow through the notch and the passage and flow into the lower chamber when the discs are moved upward, and the sealing ring is moved upward to close the aperture for preventing the water from flowing into the upper chamber via the passage and for pumping the water in the lower chamber out of the housing via the outlet by the discs when the piston rod is moved inward of the housing.

The housing includes a cover secured on top thereof for enclosing the housing and includes a gasket engaged between the housing and the cover for making a water tight seal between the housing and the cover.

The passage includes a T-shape having an opening opening for communicating with the lower chamber of the housing and having two apertures for communicating with the space.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
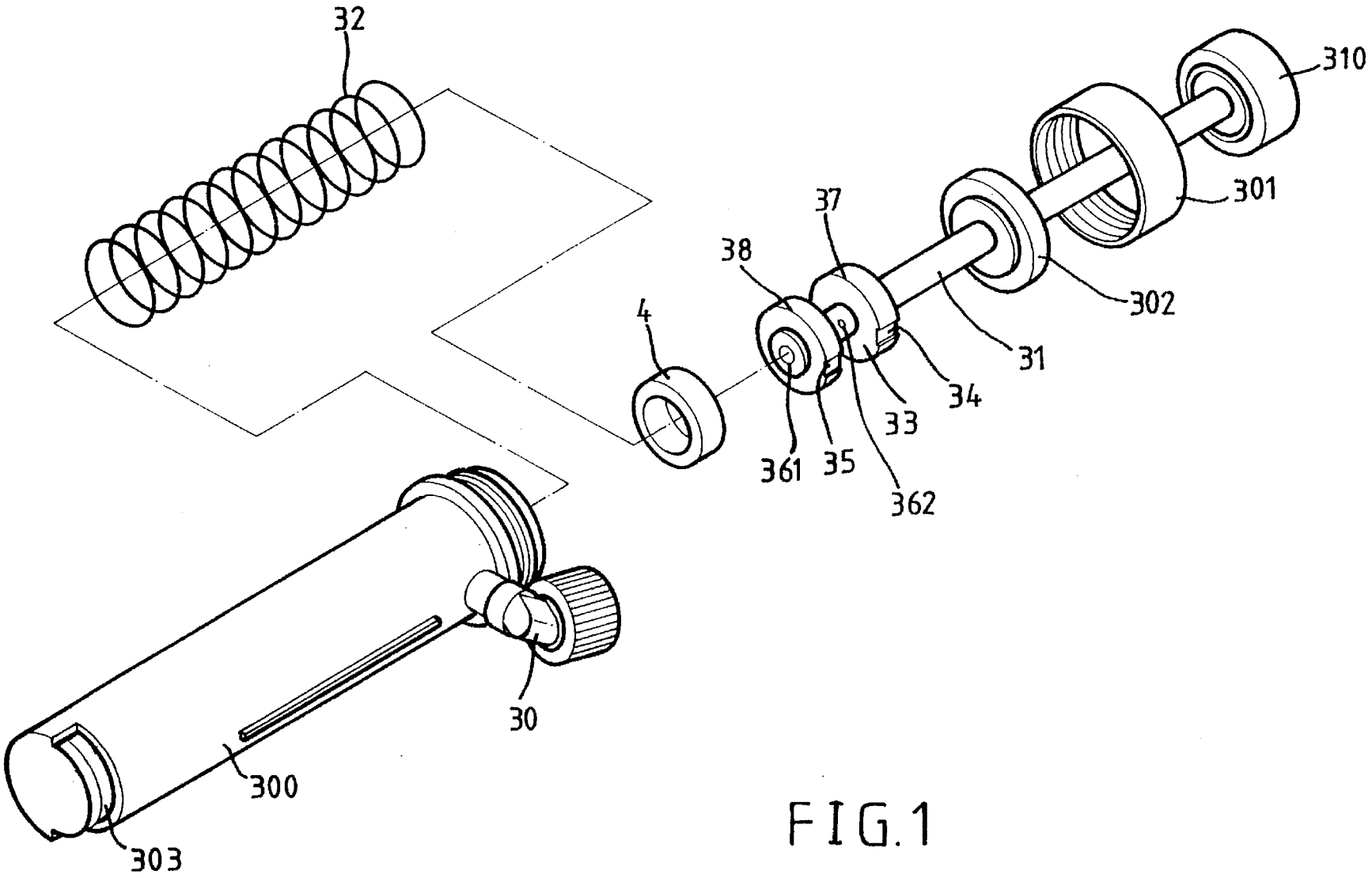
FIG. 1 is an exploded view of a hand pump for a diver drinking device in accordance with the present invention.
Figure 2:
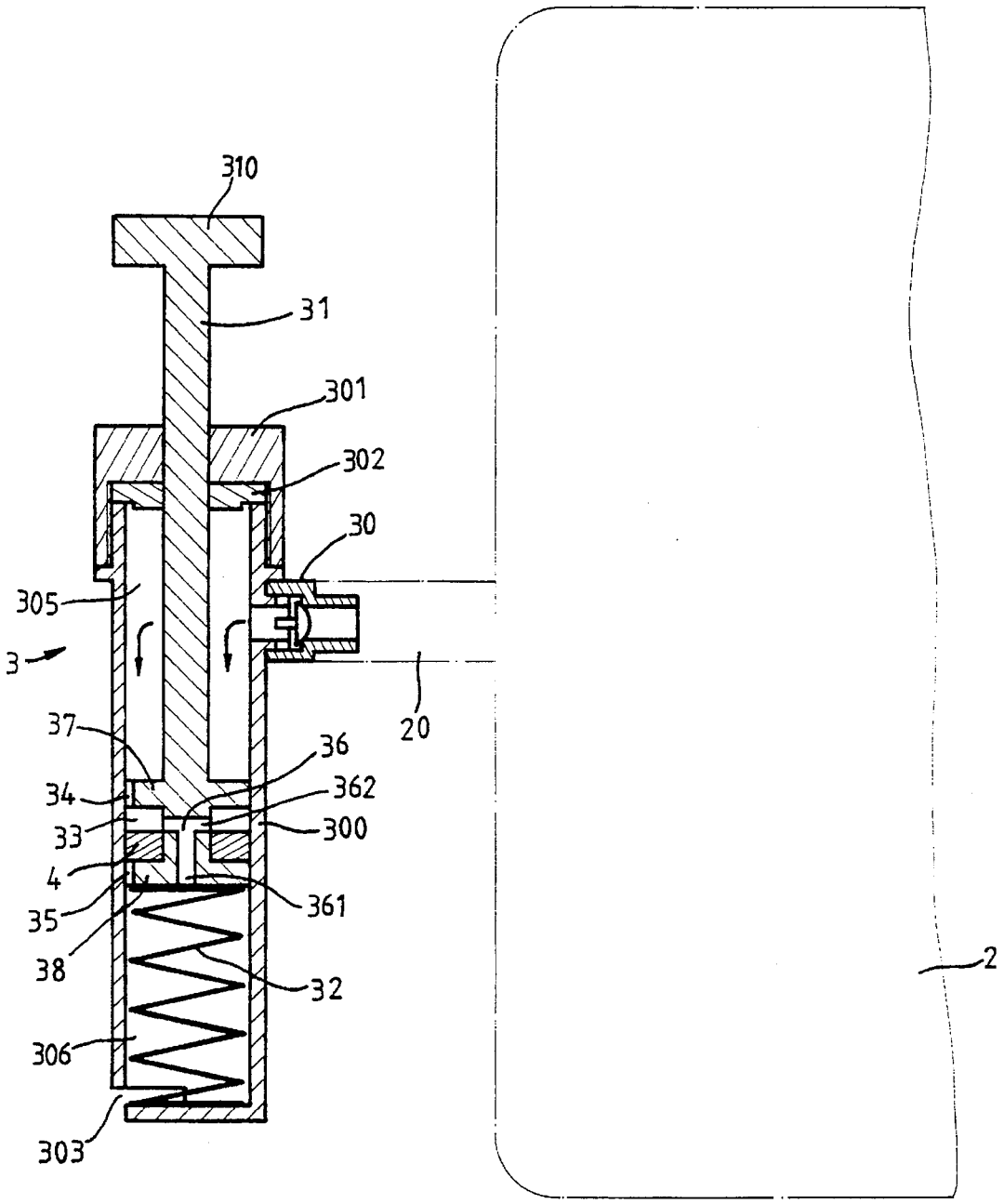
FIGS. 2 and 3 are cross sectional views illustrating the application of the hand pump.

Referring to the drawings, and initially to FIGS. 1 and 2, a drinking device for a diver in accordance with the present invention comprises a water container 2 coupled to an inlet valve 30 of a housing 300 of a hand pump 3 by a hose 20 for supplying water into the hand pump 3. The housing 300 includes a cover 301 secured on top thereof for enclosing the housing 300 and a gasket 302 engaged between the housing 300 and the cover 301 for making a water tight seal between the housing 300 and the cover 301. The housing 300 includes an outlet 303 formed in the bottom portion thereof.

Figure 3:
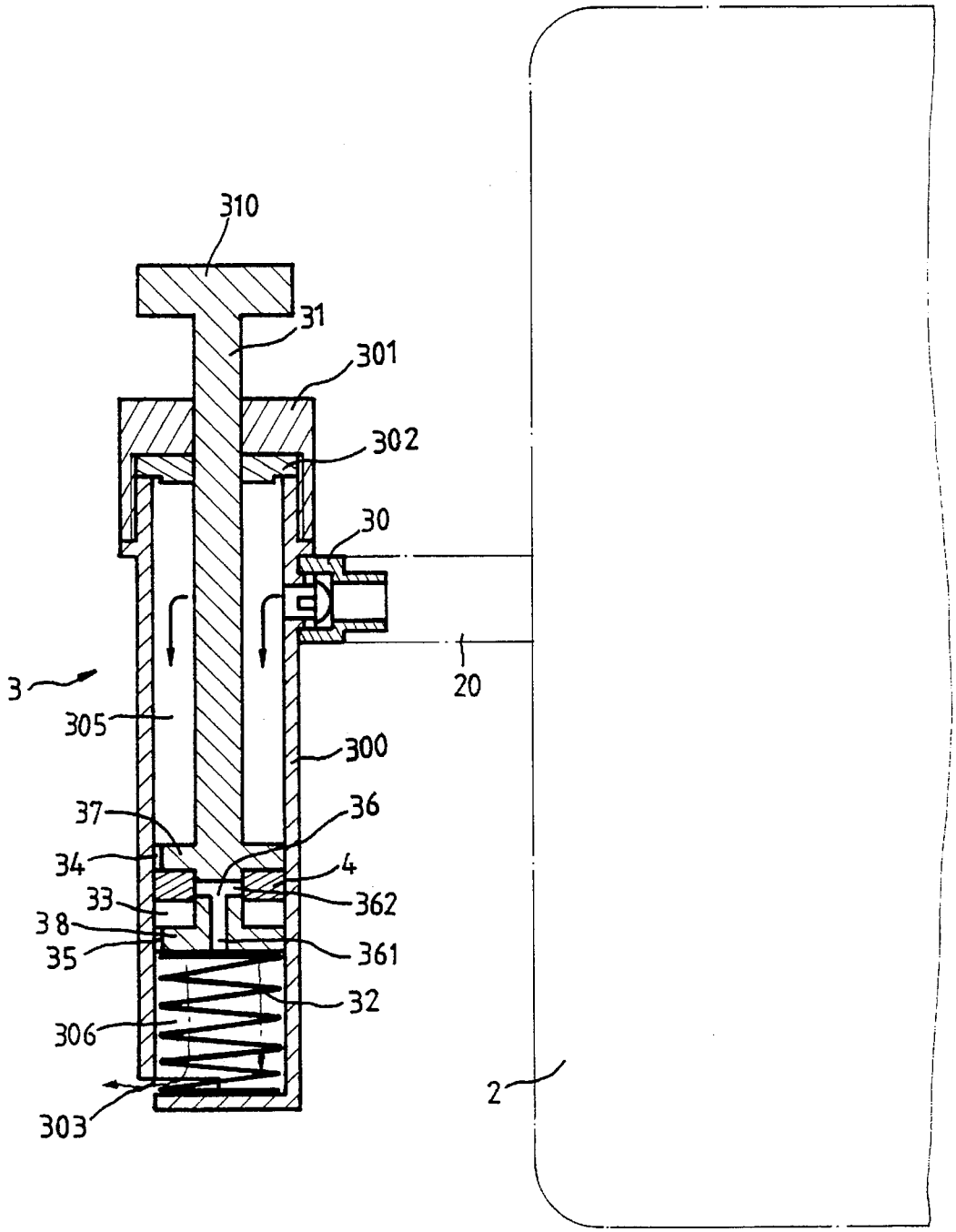

A piston rod 31 has a lower portion slidably engaged in the housing 300 and has a handle 310 secured on top thereof for operating the piston rod 31 and for actuating the piston rod 31 to move inward and outward of the housing 300. A pair of discs 37, 38 are secured to the lower portion of the piston rod 31 and are arranged in parallel with each other so as to form a space 33 therebetween. The discs 37, 38 each includes a notch 34, 35 formed therein. The discs 37, 38 separate the interior of the housing 300 into an upper chamber 305 and a lower chamber 306. A spring 32 is engaged in the lower chamber 306 or the housing 300 and engaged with the disc 38. A T-shaped passage 36 is formed in the lower portion of the piston rod 31 and includes an opening 361 for communicating with the lower chamber 306 of the housing 300 and includes two apertures 362 for communicating with the space 33. A sealing ring 4 is slidably disposed in the space 33 and has a smaller diameter than that of the space 33 for allowing the sealing ring 4 to move upward to close the apertures 362 (FIG. 3) and for allowing the sealing ring 4 to move downward to open the apertures 362 (FIG.2).

In operation, as shown in FIG. 2, when the discs 37, 38 are moved upward by the handle 310 or are biased upward by the spring 32, the sealing ring 4 has a tendency to move downward to open the apertures 362. At this moment, the water contained in the water container 2 and received in the upper chamber 305 may flow through the notch 34 and the passage 36 and flow into the lower chamber 306 via the opening 361. When it is required to pump water into the diver's mouth, it is only required to move the piston rod 31 inward of the housing 300 by the handle 310. At this moment, the sealing ring 4 is caused to move upward to close the apertures 362 such that water is prevented from flowing into the upper chamber 305 via the passage 36 and such that the water contained in the lower chamber 306 may be pumped out of the housing 300 via the outlet 303 by the discs 37, 38 and the sealing ring 4.

No large force will be applied onto the sealing ring 4 such that the sealing ring 4 will not be easily become fatigued and may have a longer working life.

Accordingly, the water drinking device in accordance with the present invention includes a hand pump for effectively pumping water into the diver's mouth.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A drinking device for a diver, said drinking device comprising:

a water container, hand pump including a housing having an inlet valve coupled to said water container for receiving water from said water container, said housing including a lower portion having an outlet formed therein, said housing including an interior, a piston rod including a lower portion slidably engaged in said housing and including an upper portion having a handle secured thereon for operating said piston rod, said piston rod including a pair of discs secured to said lower portion and slidably engaged in said interior of said housing and arranged to form a space between said discs, said discs each including a notch formed therein for allowing water to flow through said discs, said discs separating said interior of said housing into an upper chamber and a lower chamber, a passage formed in said lower portion of said piston rod and including an opening for communicating with said lower chamber of said housing and including at least one aperture for communicating with said space, a sealing ring slidably disposed in said space and having a smaller diameter than that of said space for allowing said sealing ring to move upward to close said aperture and for allowing said sealing ring to move downward to open said aperture, and means for biasing said discs toward said upper chamber of said housing, said sealing ring being moved downward to open said aperture for allowing water in said upper chamber to flow through one of said notches and said passage and flow into said lower chamber when said discs are moved upward, and said sealing ring being moved upward to close said aperture for preventing the water from flowing into said upper chamber via said passage and for pumping the water in said lower chamber out of said housing via said outlet by said discs when said piston rod is moved inward of said housing.

2. A drinking device according to claim 1, wherein said housing includes a cover secured on top thereof for enclosing said housing and includes a gasket engaged between said housing and said cover for making a water tight seal between said housing and said cover.

3. A drinking device according to claim 1, wherein said passage includes a T-shape having an opening for communicating with said lower chamber said housing and having two apertures for communicating with said space.

* * * * *